US007137846B1

(12) United States Patent
Lim et al.

(10) Patent No.: US 7,137,846 B1
(45) Date of Patent: Nov. 21, 2006

(54) POWER CORD

(75) Inventors: Jong-kook Lim, Gwangju (KR); Keon-soo Choi, Gwangju (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 0 days.

(21) Appl. No.: 11/331,175

(22) Filed: Jan. 13, 2006

(30) Foreign Application Priority Data

Apr. 27, 2005 (KR) ..... 10-2005-0035029

(51) Int. Cl.
*H01R 13/56* (2006.01)

(52) U.S. Cl. ..... 439/447

(58) Field of Classification Search ..... 439/445, 439/447, 448; 385/86
See application file for complete search history.

(56) References Cited

U.S. PATENT DOCUMENTS 3,786,397 A * 1/1974 Bridges ..... 439/277
5,929,386 A 7/1999 Hornick
6,068,506 A * 5/2000 Shen ..... 439/447
6,126,477 A * 10/2000 Smith et al. ..... 439/447
6,840,795 B1 * 1/2005 Takeda et al. ..... 439/492
2003/0236020 A1 * 12/2003 Iamartino et al. ..... 439/445
2005/0197010 A1 9/2005 Ching

FOREIGN PATENT DOCUMENTS

DE 04022573 C1 8/1991
KR 1986-11092 9/1986
KR 1995-0001482 3/1995

OTHER PUBLICATIONS

Australian Patent Office, Office Action issued May 4, 2006, with respect to Australian Patent Application No. 2006200978 filed on Mar. 7, 2006.

* cited by examiner

*Primary Examiner*—Tho D. Ta
(74) *Attorney, Agent, or Firm*—Blank Rome LLP

(57) ABSTRACT

A power cord that includes a plug body supporting an electric wire and including a connecting part, a protecting tube coupled to the plug body, and a movement regulating protrusion formed on the electric wire preventing the protecting tube from separating from the connecting part, wherein a space is formed between an inner surface of the protecting tube and the electric wire.

12 Claims, 2 Drawing Sheets

POWER CORD

CROSS-REFERENCE TO RELATED APPLICATION

This application claims priority under 35 U.S.C. § 119(a) to Korean Patent Application No. 2005-35029, filed Apr. 27, 2005 in the Korean Intellectual Property Office, the entire contents of which are incorporated herein by reference.

FIELD OF THE INVENTION

The present invention relates to a power cord. More particularly, the present invention relates to a power cord having a protecting tube to protect a user from a spark caused by a leakage of electricity and breaking of wire.

BACKGROUND OF THE INVENTION

Often the electric wire of conventional power cords are bent or folded, thereby breaking the wire. To avoid breaking the wire, a reinforcing agent is generally used with the connecting part between the electric wire and the plug body.

For example, Korean Utility Model Laid-open No. 1986-11092 discloses a reinforcing agent formed in a connecting part between an electric wire and a plug body, and a tubular wire breakage protecting part integrally formed therewith that extends backward with the reinforcing agent. This structure can prevent direct contact with the electric wire, however the wire breakage protecting part is open so that the user can still get an electric shock. In addition, a spark caused by the electric wire at the open part of the wire breakage protecting part may cause a fire.

SUMMARY OF THE INVENTION

An aspect of the present invention is to solve at least the above problems and/or disadvantages and to provide at least the advantages described below. Accordingly, an aspect of the present invention is to provide a power cord that prevents an electric shock or a fire if the wire between a plug body and an electric wire is broken.

Another aspect of the present invention is to provide a power cord having a protecting tube which is not easily detachable.

In order to achieve the above-described aspects of the present invention, there is provided a power cord supporting an electric wire and including a connecting part having a plug body a protecting tube the plug body and a movement regulating protrusion formed on the electric wire preventing the protecting tube from separating from the connecting part, wherein a space is formed between an inner surface of the protecting tube and the electric wire.

According to an exemplary embodiment, the plug body may comprise a supporting protrusion to support one end of the protecting tube. The supporting protrusion may be integrally formed with the plug body, and the movement regulating protrusion may be integrally formed with the electric wire by injection molding.

The one end of the protecting tube may be bent towards center of the protecting tube to prevent separation and contacts the movement regulating protrusion and the electric wire together. The protecting tube may be formed of an elastic nonconductive material, such as rubber or resin.

As can be appreciated from the above description of the present invention, direct exposure to a broken wire between the plug body and the electric wire is prevented thereby reducing the occurrence of electric shock and fire.

BRIEF DESCRIPTION OF THE DRAWING FIGURES

The above aspect and other features of the present invention will become more apparent by describing in detail exemplary embodiments thereof with reference to the attached drawing figures, wherein.

DETAILED DESCRIPTION OF THE EXEMPLARY EMBODIMENTS

Hereinafter, an embodiment of the present invention will be described in detail with reference to the accompanying drawing figures.

Figure 1:
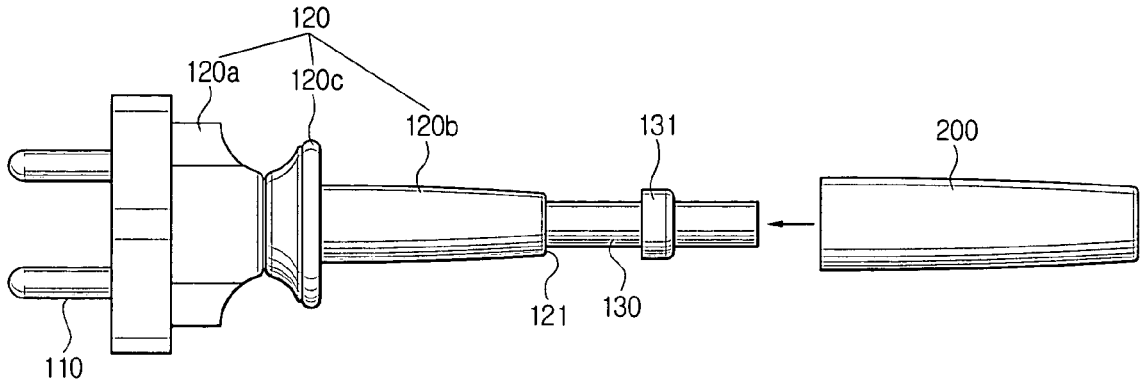
FIG. 1 is an exploded elevational view of a power cord according to an embodiment of the present invention.

As shown in FIG. 1, the power cord includes at least one plug pin 110, a plug body 120, an electric wire 130, and a protecting tube 200. A supporting protrusion 120*c* and a movement regulating protrusion 131 for supporting the protecting tube 200 may be integrally formed at the plug body 120 and the electric wire 130 respectively. The electric wire 130 is an electric wire (now shown) covered with coating material and is a flexible stranded cable for user convenience.

The plug pin 110 is inserted in a wall outlet (not shown) and receives electricity. The plug body 120 includes a plug base 120*a*, a plug extended part 120*b* and the supporting protrusion 120*c*. The plug base 120*a* forms the body of the plug, and the plug pin 110 and the electric wire 130 are wired inside the plug base 120*a*. The plug extended part 120*b* extends from the plug base 120*a* and supports the electric wire 130. The supporting protrusion 120*c* is formed with the plug base 120*a* allowing a user to easily grasp the plug body 120 and restricts the installation location of the protecting tube 200. The plug base 120*a*, the plug extended part 120*b* and the supporting protrusion 120*c* maybe injection molded with hard resin, for example. By injection molding the plug body 120 breaking of the wire due to frequent use is significantly reduced. However, a connecting part 121 between the plug body 120 and the electric wire 130 is frequently folded or bent, resulting in the coating material of the electric wire 130 wearing out, thereby exposing the wire.

If the connecting part 121 wears out and the wire is exposed, the protecting tube 200 substantially prevents an electric shock of a user and a fire by spark by covering the connecting part 121. The protecting tube 200 may be formed of a nonconductive material, such as rubber or resin, to block leaking electricity.

Figure 2:
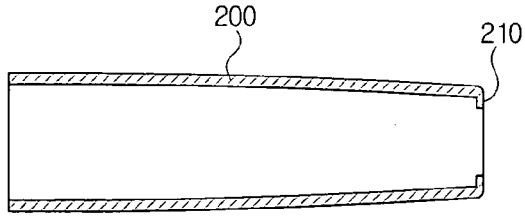
FIG. 2 is an elevational view of a protecting tube in section of the power cord according to an embodiment of the present invention.
Figure 3:
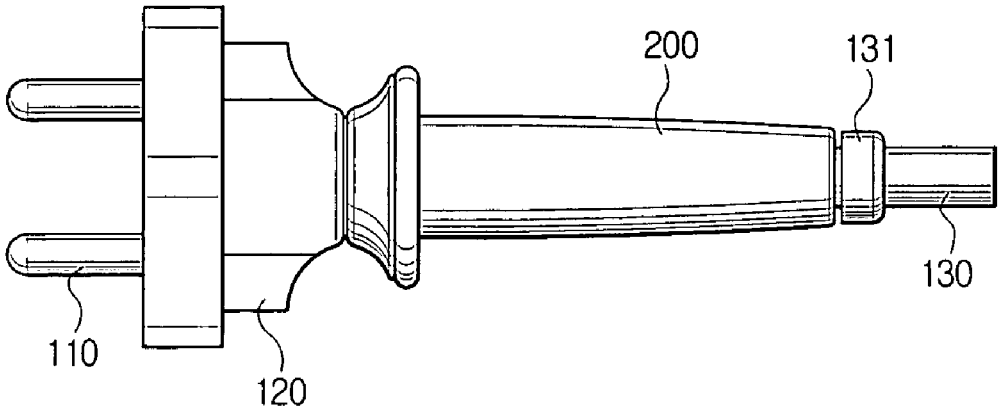
FIG. 3 is an elevational view of the power cord showing the power cord coupled to the protecting tube of FIG. 2.

As shown in FIGS. 2 and 3, one end of the protecting tube 200 is supported by the supporting protrusion 120*c*. The protecting tube 200 is prevented from separating from the plug body 120 by the movement regulating protrusion 131. The protrusion 131 can be molded with the coating material on the electric wire 130. A supporting surface 210 is formed at the another end of the protecting tube 200 which contacts the movement regulating protrusion 131. The supporting surface 210 extends toward the center of the protecting tube 200 so that the supporting surface 210 contacts the movement regulating protrusion 131 and the electric wire 130 simultaneously.

Figure 4:
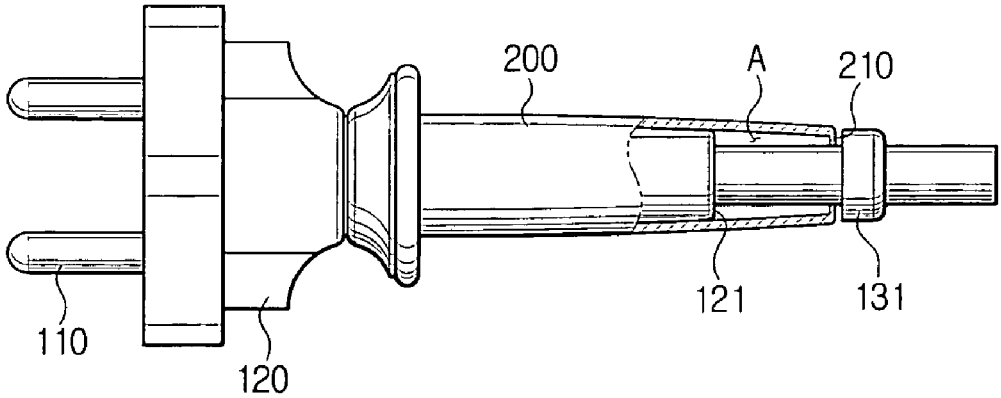
FIG. 4 is an elevational view of the power cord, showing the protecting tube in partial section, according to an embodiment of the present invention.

According to the exemplary embodiment, the supporting surface 210, as shown FIGS. 2 and 4, is bent in the form of a generally right angle and plane-contacts the movement regulating protrusion 131. When the protecting tube 200 is assembled with the plug body 120 in the direction of the arrow in FIG. 1, the supporting surface 210 elastically expands outward by the movement regulating protrusion 131, and the protecting tube 200 passes over the movement regulating protrusion 131. However, when the protecting tube 200 moves in the opposite direction, the end of the supporting surface 210 rubs with the electric wire 130, and abuts the movement regulating protrusion 131. Therefore, it is easy for the protecting tube 200 to pass over the movement regulating protrusion 131 but it is not easy for the protecting tube 200 separate from the plug body 120 due to the movement regulating protrusion 131.

Further, the protecting tube 200 may be tightly coupled with the plug extended part 120*b* and a space (A) is formed at the stepped part between the plug extended part 120*b* and the electric wire 130, as seen in FIG. 4. The space (A) functions as a buffer between the connecting part 121 and the protecting tube 200, so that even if the coating material of wire 130 is broken and a spark occurs, the spark discharges in the space (A), and the protecting tube 200 is not affected by electricity of spark discharge. Because the spark can not escape the airtight space (A) formed by the protecting tube 200 and the movement regulating protrusion 131, a fire caused by a short circuit of the wire 130 can be prevented.

As can be appreciated from the above description of the present invention, if the wire breaks between the plug body and the electric wire direct exposure to a user is substantially prevented, thereby reducing electric shock and a fire. The movement regulating protrusion formed with the electric wire by injection molding prevents the protecting tube from separating. Additionally, the supporting protrusion for supporting one end of the protecting tube provides a handle allowing the user to easily pull the plug out.

While the invention has been shown and described with reference to certain embodiments thereof, it will be understood by those skilled in the art that various changes in form and details may be made therein without departing from the spirit and scope of the invention as defined by the appended claims.

What is claimed is:

1. A power cord comprising:

a plug body supporting an electric wire and including a connecting part and a supporting protrusion;

a protecting tube coupled to the plug body the supporting protrusion of the plug body supporting one end of the protecting tube; and a movement regulating protrusion formed on the electric wire preventing the protecting tube from separating from the connecting part, wherein a space is formed between an inner surface of the protecting tube and the electric wire.

2. The power cord of claim 1, wherein the supporting protrusion is integrally formed with the plug body, and the movement regulating protrusion is integrally formed with the electric wire.

3. The power cord of claim 1, wherein one end of the protecting tube is bent towards center of the protecting tube.

4. The power cord of claim 1, wherein the protecting tube contacts the movement regulating protrusion and the electric wire.

5. The power cord of claim 1, wherein the supporting protrusion is remote from the connecting part.

6. The power cord of claim 1, wherein the protecting tube is formed of an elastic nonconductive material.

7. The power cord of claim 6, wherein the elastic nonconductive material is one of rubber and resin.

8. A power cord comprising:

a plug body supporting an electric wire and including a connecting part;

a protecting tube coupled to the plug body; and a movement regulating protrusion formed on the electric wire outside of the protecting tube preventing the protecting tube from separating from the connecting part, wherein a space is formed between an inner surface of the protecting tube and the electric wire.

9. The power cord of claim 8, further comprising a supporting protrusion is integrally formed with the plug body for supporting the protecting tube, and the movement regulating protrusion is integrally formed with the electric wire.

10. The power cord of claim 8, wherein one end of the protecting tube is bent towards center of the protecting tube.

11. The power cord of claim 8, wherein the protecting tube contacts the movement regulating protrusion and the electric wire.

12. The power cord of claim 8, wherein the protecting tube is formed of an elastic non-conductive material.

* * * * *